US006805197B2

(12) United States Patent
Brumley et al.

(10) Patent No.: US 6,805,197 B2
(45) Date of Patent: Oct. 19, 2004

(54) HYDRAULIC WIRELINE CUTTER

(75) Inventors: Kenneth A. Brumley, Houston, TX (US); John P. Davis, Cypress, TX (US); Gregory L Hern, Huffman, TX (US); David B. Haughton, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/175,017

(22) Filed: Jun. 18, 2002

(65) Prior Publication Data

US 2002/0152856 A1 Oct. 24, 2002

Related U.S. Application Data

(62) Division of application No. 09/680,579, filed on Oct. 6, 2000, now Pat. No. 6,763,753.

(51) Int. Cl.[7] ..... E21B 29/04; E21B 43/00

(52) U.S. Cl. ..... 166/298; 166/54.5; 166/55.3; 166/55.8; 166/301

(58) Field of Search ..... 166/298, 301, 166/55.3, 55.8, 54.5, 54.6, 297; 83/188, 636, 54, 539.1–639.7, 191, 195, 907, 909, 424

(56) References Cited

U.S. PATENT DOCUMENTS

| | | | | |
|---|---|---|---|---|
| 2,185,303 A | * | 1/1940 | Kinley | 166/54.6 |
| 2,794,619 A | * | 6/1957 | Lawrence et al. | 166/54.6 |
| 2,825,536 A | * | 3/1958 | Kenneday et al. | 166/54.5 |
| 3,010,515 A | * | 11/1961 | Harrison et al. | 166/54.5 |
| 3,023,811 A | * | 3/1962 | Green | 166/178 |
| 3,193,013 A | * | 7/1965 | Whiteside | 166/54.5 |
| 3,358,765 A | * | 12/1967 | Le Blanc | 166/301 |
| 3,872,926 A | | 3/1975 | Van Gils | |
| 3,926,252 A | | 12/1975 | Ribeyre et al. | |
| 4,160,478 A | | 7/1979 | Calhoun et al. | |
| 4,237,972 A | * | 12/1980 | Lanmon, II | 166/54.5 |
| 4,341,264 A | | 7/1982 | Cox et al. | |
| 4,455,746 A | | 6/1984 | Idzik et al. | |
| 4,509,593 A | * | 4/1985 | Traver et al. | 166/63 |
| 4,512,411 A | | 4/1985 | Pringle | |
| 4,540,046 A | | 9/1985 | Granger et al. | |
| 4,660,635 A | * | 4/1987 | Wittrisch | 166/54.5 |
| 4,678,038 A | * | 7/1987 | Rankin | 166/301 |
| 4,844,660 A | | 7/1989 | Ortemond | |
| 4,862,964 A | | 9/1989 | George et al. | |
| 4,886,115 A | * | 12/1989 | Leggett et al. | 166/77.1 |
| 4,969,514 A | | 11/1990 | Morris et al. | |
| 5,318,139 A | * | 6/1994 | Evans | 175/297 |
| 5,477,921 A | * | 12/1995 | Tollefsen | 166/250.13 |
| 5,720,348 A | | 2/1998 | Hisaw | |
| 5,778,978 A | * | 7/1998 | Crow | 166/254.2 |
| 6,125,834 A | * | 10/2000 | Ciccarelli et al. | 124/65 |
| 6,155,150 A | | 12/2000 | Cooper et al. | |

FOREIGN PATENT DOCUMENTS

| | | |
|---|---|---|
| EP | 0206909 A1 | 12/1986 |
| GB | 2157742 A | 10/1985 |

OTHER PUBLICATIONS

Bowen; *Bowen Instruction Manual*, Bowen Series 150 Releasing & Circulating Overshot; date unknown; 2 pages.
Kinley Corporation; Kinley Sand Line Cutter description; date unknown; 2 pages.

* cited by examiner

*Primary Examiner*—Kenneth E. Peterson
*Assistant Examiner*—Isaac N Hamilton
(74) *Attorney, Agent, or Firm*—Gerald W. Spinks

(57) ABSTRACT

A combination tool for attaching to a stuck wireline tool, then cutting the wireline just above the stuck tool with a hydraulically driven cutter, allowing the wireline to be pulled out of the hole before fishing out the stuck tool. A side door can be provided on the work string, to allow rerouting of the wireline outside the work string, after which the stuck tool can be unstuck and repositioned within the well bore for completion of the downhole operation of the tool, prior to cutting the wireline free from the downhole tool.

8 Claims, 3 Drawing Sheets

HYDRAULIC WIRELINE CUTTER

CROSS REFERENCE TO RELATED APPLICATIONS

This is a divisional patent application of co-pending U.S. patent application Ser. No. 09/680,579, filed on Oct. 06, 2000, now U.S. Pat. No. 6,763,753 and entitled "Hydraulic Wireline Cutter."

STATEMENT REGARDING FEDERALLY SPONSORED RESEARCH OR DEVELOPMENT

Not Applicable

BACKGROUND OF THE INVENTION

1. Field of the Invention

This invention is in the field of retrieving stuck tools which are suspended downhole in an oil or gas well on a wireline.

2. Background Art

During the drilling of an oil or gas well, tools called well logging tools are often run into the well bore suspended on a wireline. These tools can be used for such purposes as measuring various properties of the earth formation at selected depths. While suspended in the well bore, such tools sometimes become stuck, either in an open hole portion of the well bore, or even in a cased portion. It then becomes necessary to retrieve the stuck tool from the well bore. In open hole, this is usually done by cutting the wireline at the earth's surface, then running a drill pipe into the well over the wireline. An attachment tool, such as a grappling tool, on the lower end of the drill string is attached to the stuck tool. Then, the wireline is pulled until it separates from the cable head on the stuck tool, and the downhole tool is then retrieved with the drill string. In cased hole, the wireline is normally pulled out of the cable head first, then the stuck tool is fished out, either with a wireline fishing tool or a tubing conveyed fishing tool.

The retrieval operation is sometimes further complicated by an unplanned separation of the wireline some distance above the tool, rather than at the cable head, leaving some portion of the wireline in the well, suspended above or lying on top of the stuck tool. This unplanned separation of the wireline can also occur when the wireline is pulled in order to loosen or retrieve a stuck tool.

Unplanned separation of the wireline can be minimized by including a weak point in the string, just above the suspended tool. This insures that the wireline will break at this weak point, allowing all of the wireline to be retrieved from the well bore before fishing or retrieval of the stuck tool is attempted. Unfortunately, the use of a weak point limits the weight of the tool string that can be suspended from a wireline, as well as the amount of pull the operator can apply in order to free a stuck tool.

Unplanned separation of the wireline can also be minimized by including an explosive driven wireline cutter above the downhole tool. Such tools suffer from the disadvantage that they must be installed in the wireline before running in the tool, and they require a separate fishing operation after the wireline is severed. Explosively severing the wireline can also loosen the attachment between a grappling tool and the stuck tool.

Even when the retrieval operation goes without complications, since the wireline is severed before unsticking the tool, the stuck tool must be completely removed from the well bore, then a new or reconnected tool run back into the well to complete the logging operation which was originally underway.

It would be beneficial, then, to have a combination tool which can attach to a stuck tool, loosen the stuck tool, sever the wireline just above the tool allowing retrieval of the wireline, and then retrieve the tool. It would also be beneficial to be able to attach to the stuck tool, loosen and reposition the tool for completion of its original operation, and then have the ability to sever the wireline if necessary, all with a single tool.

BRIEF SUMMARY OF THE INVENTION

The present invention is a combination tool including an attachment tool such as a grapple, and a hydraulically driven wireline cutter, both mounted on a tubular work string. The work string is lowered into the well bore over the wireline, and the grapple is attached to the stuck tool. The work string can be raised and lowered slightly, to confirm the attachment. Fluid flow is then increased to drive a piston and wedge, which in turn drives a cutter blade through the wireline, severing it just above the stuck tool. The entire length of the wireline can then be pulled from the well, after which the work string is used to loosen and retrieve the stuck tool.

Alternatively, after the grapple is attached to the stuck tool, the wireline can be cut at the well site on the earth surface and routed through a side door in the work string, and reconnected. Then, the work string can be used to loosen the stuck tool and reposition it downhole as required for the completion of the originally planned operation of the tool, such as well logging operations. Then, the entire assembly can be retrieved with the work string, or the wireline can be hydraulically severed at the stuck tool and retrieved, followed by retrieval of the stuck tool itself.

The novel features of this invention, as well as the invention itself, will be best understood from the attached drawings, taken along with the following description, in which similar reference characters refer to similar parts, and in which:

DETAILED DESCRIPTION OF THE INVENTION

Figure 1:
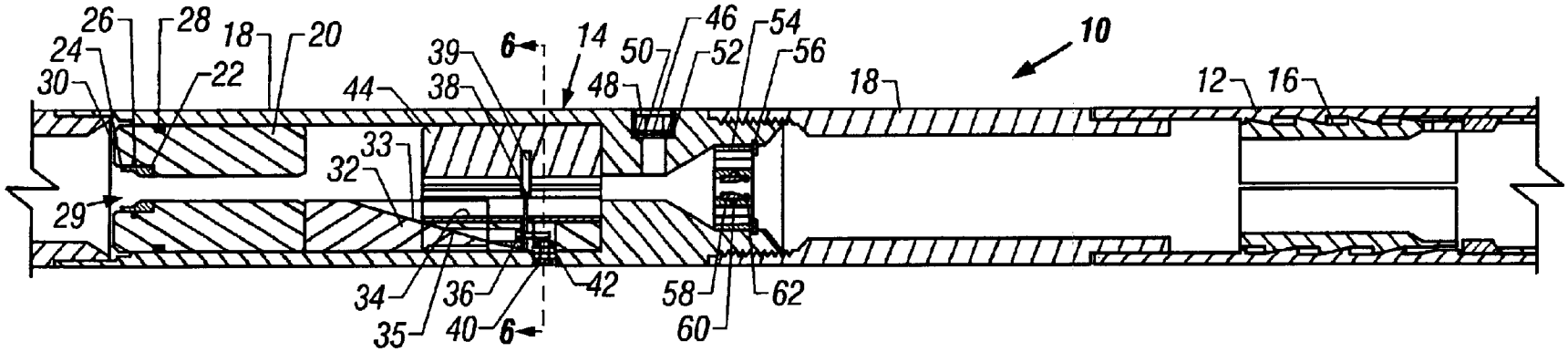
FIG. 1 is a longitudinal section view of the apparatus of the present invention.

As shown in FIG. 1, the wireline cutting and retrieval apparatus 10 of the present invention includes a grappling device 12 and a hydraulic cutting device 14 mounted adjacent the lower end of a tubular work string 18. The grappling device 12 can include a grapple 16 as is well known in the art, or any other type of attachment device suited for attaching the work string to the particular wireline tool that may be stuck downhole.

A piston 20 is slidably mounted for longitudinal motion in the work string 18, sealed against the work string 18 by a seal 28. An upper nozzle 22 is mounted adjacent the upper end 30 of the piston 20, in a fluid flow path 29 through the piston 20. The upper nozzle 22 can be retained in the piston 20 by a retainer ring 24, and sealed by a seal 26.

Figure 5:
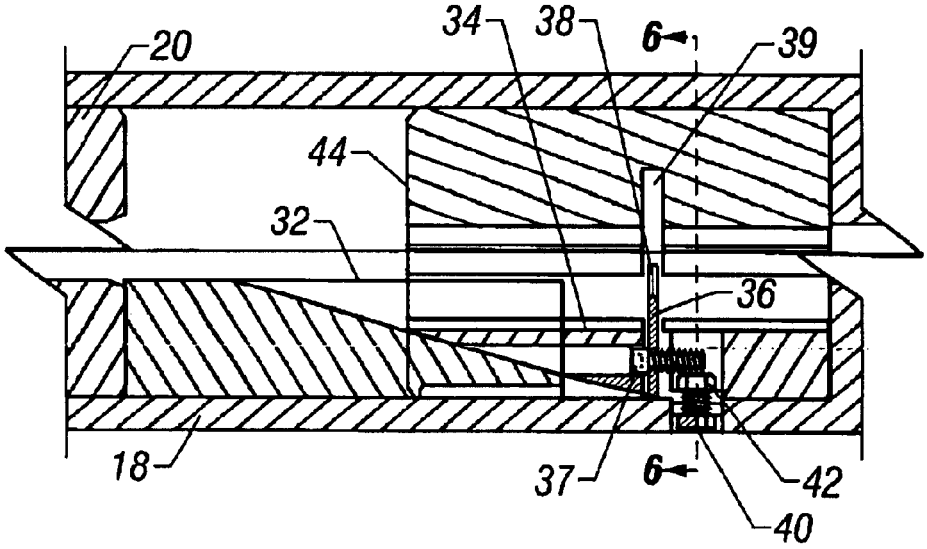
FIG. 5 is a longitudinal section view of the hydraulic cutter device used in the apparatus shown in FIG. 1.

As more easily seen in FIG. 5, the lower end of the piston 20 abuts the upper end of an upper wedge 32, which has an inwardly facing ramp 33 sloping outwardly from the axis of the apparatus 10 and downwardly. The inwardly facing ramp 33 on the upper wedge 32 abuts an outwardly facing ramp 35 on a lower wedge 34. The outwardly facing ramp 35 also slopes outwardly from the axis of the apparatus 10 and downwardly. A cutter blade 36 is oriented transverse to the axis of the apparatus 10, and mounted to the lower wedge 34, for example by a fastener 37. The cutter blade 36 has an inwardly oriented cutting edge 38. The cutter blade 36 is mounted for transverse motion within a transverse slot 39 in a cutter body 44.

The lower wedge 34 can be attached to the work string 18 by a shearable device, such as a shear screw 40 and nut 42. The shear screw 40 retains the lower wedge 34, upper wedge 32, and piston 20 in place relative to the work string 18. This maintains the cutter blade 36 in its retracted position as shown in FIGS. 1 and 5.

As shown in FIG. 1, a rupturable device, such as a rupture disk 46 is mounted in the wall of the work string 18, below the piston 20 and the upper nozzle 22. The rupture disk 46 can be held in place by a retainer nut 48 and control washers 50, 52. The rupture disk 46 separates a fluid flow path 29 through the work string 18 from the well bore annulus surrounding the work string 18. A debris barrier 54 is mounted in the bore of the work string 18 below the position of the rupture disk 46, held in place by a retainer 56. The debris barrier 54 can limit the accumulation of debris in the moving parts of the apparatus 10 as it is lowered into the well bore. A lower nozzle 58 is mounted in the debris barrier 54, held in place by a retainer 62, and sealed by a seal 60. The lower nozzle 58 serves as a guide through the debris barrier 54 for the wireline.

Figure 2:
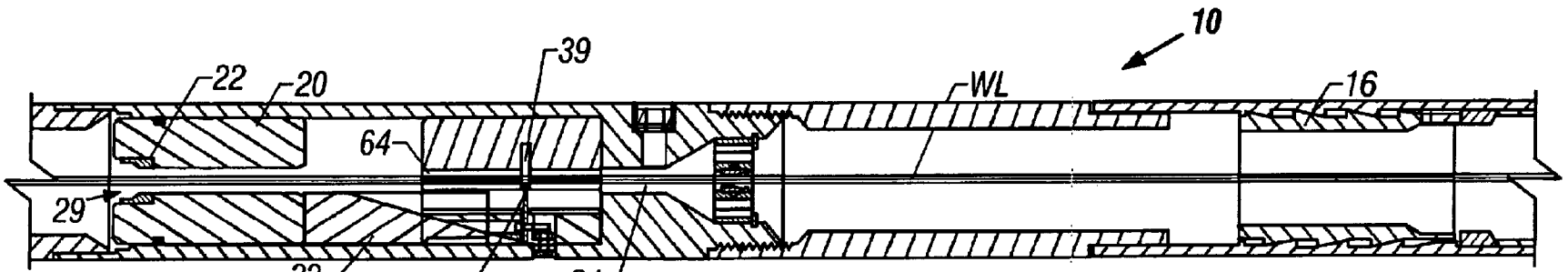
FIG. 2 is a longitudinal section view of the apparatus shown in FIG. 1, with a wireline passing therethrough.

FIG. 2 shows the apparatus 10 as it is being run into the well bore over a wireline WL. The wireline WL passes through a passageway 64 through the piston 20, the cutter body 44, the debris barrier 54, and the grapple 16. At this point, it can be seen that the grapple 16 is still unengaged, the rupture disk 46 is still intact, the piston 20 is still in its upper position, and the blade 36 is still in its retracted position. These components maintain these positions until after the apparatus 10 contacts and attaches to the top of a stuck tool suspended on the wireline WL. Just prior to attachment to the stuck tool, fluid is circulated through the apparatus 10 to clear the grappling device 12 of debris. Then, the apparatus 10 is set down on the tool to engage it with the grapple 16, or attachment is achieved as appropriate for the particular attachment device used.

Figure 3:
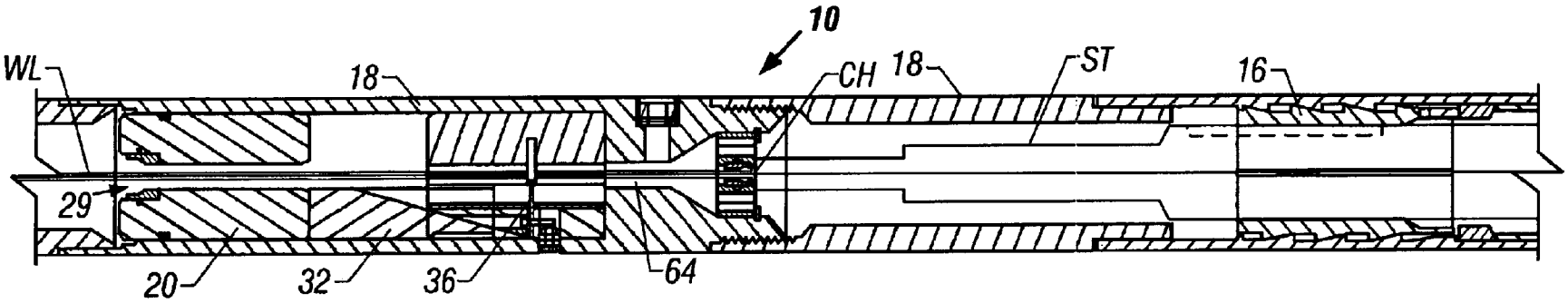
FIG. 3 is a longitudinal section view of the apparatus shown in FIG. 1, with a stuck tool attached to the grappling device.

FIG. 3 shows a stuck tool ST attached at the cable head CH to the wireline WL. The stuck tool ST is engaged by the grapple 16, as is well known in the art. The weight of the stuck tool ST can now be supported by the work string 18. The work string 18 can be moved longitudinally in the well bore, to observe changes in the wireline weight, confirming that the apparatus 10 is attached to the stuck tool ST.

It can be seen that fluid flow through the grapple 16 can become more constricted, or even blocked. Greater fluid flow may be required, either to control well pressure, or to allow the functioning of the cutter apparatus as described below. Fluid pressure can be increased until the rupture disk 46 is ruptured, allowing increased fluid flow through the wall of the work string 18 into the annulus.

Figure 4:
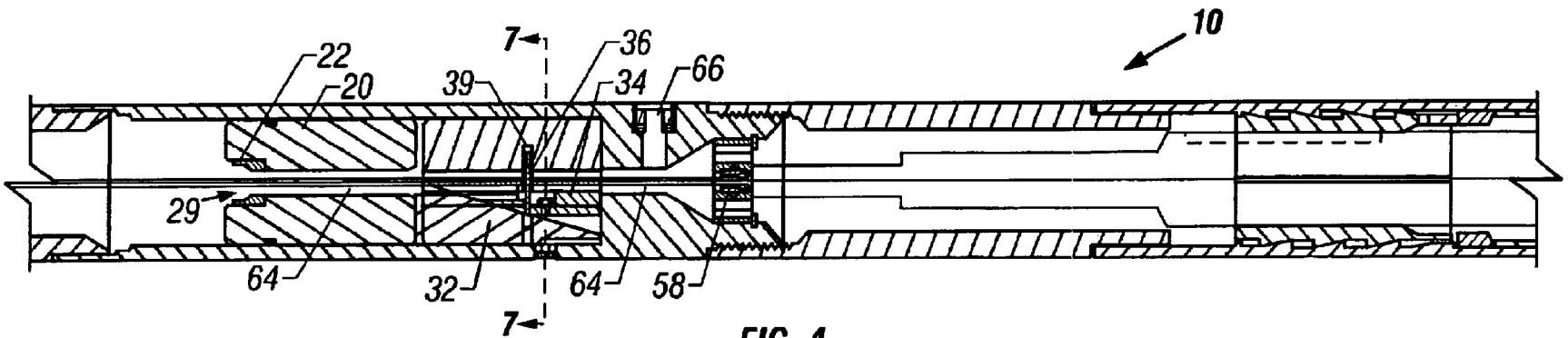
FIG. 4 is a longitudinal section view of the apparatus shown in FIG. 1, after the wireline has been cut.
Figure 6:
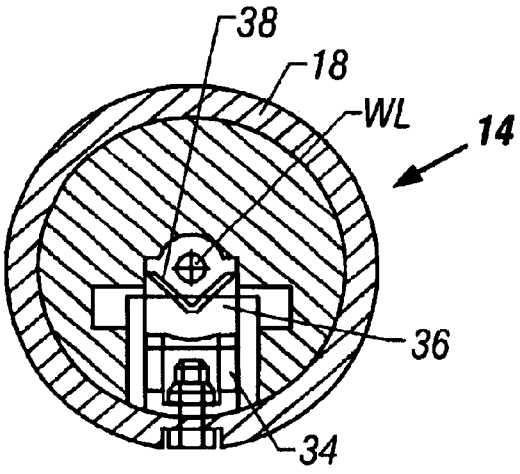
FIG. 6 is a transverse section view of the apparatus shown in FIG. 1, showing the cutter blade in its retracted position.
Figure 7:
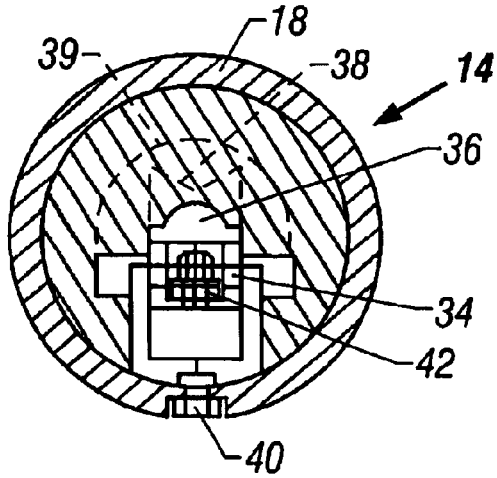
FIG. 7 is a transverse section view of the apparatus shown in FIG. 1, showing the cutter blade in its extended position.

FIG. 4 shows the situation where fluid flow has been increased through the fluid flow path 29 in the upper nozzle 22, building up a hydraulic pressure differential across the piston 20. The increased flow can be either out the end of the apparatus 10, or through the fluid flow path 66 established through the rupture disk 46. This pressure differential causes the piston 20 to press downwardly against the upper wedge 32, which in turn presses inwardly on the lower wedge 34, because of the abutment of the ramps 33, 35 on the wedges 32, 34. The exertion of this inward force on the lower wedge 34 imposes a tensile stress on the shear screw 40. When this tensile stress is sufficient to part the shear screw 40, the lower wedge 34 moves inwardly, and the piston 20 and the upper wedge 32 move downwardly. More importantly, the lower wedge 34 drives the cutter blade 36 transversely across the wireline passageway 64, cutting the wireline WL near the cable head CH. Other sherable devices could be substituted for the shear screw 40, to retain the piston 20 in its upper position until cutting of the wireline WL is desired. FIG. 6 shows more clearly the retracted position of the cutter blade 36, and FIG. 7 shows the extended position of the cutter blade 36. After the wireline WL is cut, it can be fully removed from the well bore, preventing it from complicating the loosening and retrieval of the stuck tool ST with the work string 18.

As an alternative mode of operation, instead of operating the cutting device 14 as soon as the stuck tool ST is grappled, the wireline WL could be separated at the earth surface, run through a side door in the work string 18, and reconnected, as is known in the art. Then, the work string 18 could be used to loosen the stuck tool ST and reposition it as desired in the well bore. This allows the wireline tool to complete its originally planned sequence of operations, such as logging the well, on the lower end of the work string 18. After completion of the operation of the wireline tool, it can be retrieved from the well with the work string 18, with the hydraulic cutting operation being performed at any desired time in the retrieval operation. Having the hydraulic cutting device 14 in place adjacent the grapple 16 allows the full removal of the wireline WL should this become desirable during the retrieval process, without the risk of dropping the tool, and without the need for running a separate tool.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

We claim:

1. A method for retrieving a wireline tool stuck in a well bore, comprising:

providing an attachment device, a blade, and a piston mounted adjacent a lower end of a work string;

running said work string into a well bore over a wireline to position said attachment device, said blade, and said piston adjacent to a downhole tool suspended in a well bore on said wireline;

attaching said attachment device to said downhole tool;

hydraulically driving a said piston in longitudinal movement relative to said work string;

driving a first wedge in longitudinal movement relative to said work string with said piston; and driving said blade through said wireline above said attachment device with said longitudinal movement of said first wedge, thereby severing said downhole tool from said wireline.

2. The method recited in claim 1, further comprising moving said downhole tool longitudinally in said well bore with said work string, prior to severing said wireline, thereby confirming attachment of said attachment device to said downhole tool.

3. The method recited in claim 1, further comprising:

routing said wireline through a side door in said work string; and repositioning said downhole tool to a new position in said well bore with said work string, prior to severing said wireline.

4. The method recited in claim 3, further comprising operating said downhole tool at said new position, prior to severing said wireline.

5. The method recited in claim 1, further comprising:

driving a second wedge in transverse movement relative to said work string with said longitudinal movement of said first wedge; and driving said blade in transverse movement relative to said wireline with said transverse movement of said second wedge.

6. The method recited in claim 5, further comprising generating a selected level of hydraulic differential pressure across said piston to shear a shearable device, thereby releasing said piston for said longitudinal movement.

7. The method recited in claim 6, further comprising pumping fluid through said work string and through a nozzle, at a selected fluid flow rate, to generate said selected level of hydraulic differential pressure across said piston to shear said shearable device.

8. The method recited in claim 7, further comprising rupturing a rupturable device below said nozzle, thereby establishing a sufficiently large flow path for said selected fluid flow rate.

* * * * *